US008425727B2

(12) United States Patent
Gray et al.

(10) Patent No.: US 8,425,727 B2
(45) Date of Patent: Apr. 23, 2013

(54) METHOD FOR INCREASING GLUEABILITY OF PAPER OR PAPERBOARD

(75) Inventors: Gordon Gray, Huntersville, NC (US); Patrick Dauphin, Saint-Laurent (CA)

(73) Assignee: Clariant Finance (BVI) Limited, Tortola (VG)

( * ) Notice: Subject to any disclaimer, the term of this patent is extended or adjusted under 35 U.S.C. 154(b) by 350 days.

(21) Appl. No.: 12/692,068

(22) Filed: Jan. 22, 2010

(65) Prior Publication Data

US 2011/0180226 A1 Jul. 28, 2011

(51) Int. Cl.
*D21H 17/53* (2006.01)
*C08G 63/668* (2006.01)

(52) U.S. Cl.
USPC ..... 162/164.7; 162/158; 162/231; 528/301

(58) Field of Classification Search ..... 162/128, 162/164.7, 231; 528/272, 300, 301
See application file for complete search history.

(56) References Cited

U.S. PATENT DOCUMENTS 6,153,723 A * 11/2000 Lang et al. ..... 528/300
6,489,395 B2 * 12/2002 Loffler ..... 524/845
6,833,129 B2 * 12/2004 Loffler et al. ..... 424/70.11
7,119,056 B2 * 10/2006 Koch et al. ..... 510/421
2003/0113520 A1 * 6/2003 Takahashi et al. ..... 428/201
2007/0261596 A1 * 11/2007 Fechner et al. ..... 106/460
2008/0028539 A1 * 2/2008 Koch ..... 8/115.6

FOREIGN PATENT DOCUMENTS

WO WO 2006/133867 * 12/2006
WO WO 2006/133868 * 12/2006

OTHER PUBLICATIONS

Smook, Gary A., Handbook for Pulp and Paper Technologists, 2nd ed, Angus Wilde Publications, 1992, pp. 220 and 286.*

* cited by examiner

*Primary Examiner* — Mark Halpern
*Assistant Examiner* — Dennis Cordray
(74) *Attorney, Agent, or Firm* — Tod A. Waldrop

(57) ABSTRACT

The present invention is directed to a method of treatment for paper or board including an oligoester, obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$-$C_{24}$-alcohols, $C_6$-$C_{18}$-alkylphenols or $C_8$-$C_{24}$-alkylamines and e) from 0.4 to 10 mol % of one or more polyols having from 3 to 6 hydroxyl groups, wherein the oligoester is applied to a paper or board. The treated paper or board exhibits increased gluability and surface energy.

10 Claims, No Drawings

METHOD FOR INCREASING GLUEABILITY OF PAPER OR PAPERBOARD

FIELD OF INVENTION

The invention is directed generally to method for increasing glue adhesion strength of paper or board.

BACKGROUND OF THE INVENTION

Paper and corrugated paperboard products, coated and uncoated, bleached and unbleached are commonly converted or formed into packaging. The process of converting commonly uses adhesive glue that requires good adhesion to the paper and board products. For example, when a paperboard box is formed, glue is applied to an end flap then pressed to the other end flap to seal the box. This bond fails when the glue doesn't adhere to the coating on the end flaps and comes off, instead of pulling fiber when the two ends are separated.

This invention applies a chemical product on the paper or board as a pre-treatment that will increase glue adhesion. The invention further provides for improved ink adhesion and printability of the substrate.

PRIOR ART

U.S. Pat. No. 6,153,723 A1, the complete disclosure of which is hereby incorporated herein by reference, provides an oligoester obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$—$C_{24}$-alcohols, $C_6$—$C_{18}$-alkylphenols or $C_8$—$C_{24}$-alkylamines and e) from 0.4 to 10 mol % of one or more polyols having from 3 to 6 hydroxyl groups.

SUMMARY OF THE INVENTION

According to its major aspects and briefly stated, in one aspect the invention is directed to a method of treatment that increases the bonding properties between glue and a paper or board to which it is applied. The paper or board can be coated or uncoated, bleached or unbleached. The treatment method includes applying at least one oligoester obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$—$C_{24}$-alcohols, $C_6$—$C_{18}$-alkylphenols or $C_8$—$C_{24}$-alkylamines and e) from 0.4 to 10 mol % of one or more polyols having from 3 to 6 hydroxyl groups to at least one gluing surface of a paper or board. As such, the treated paper or board, is highly useful for applications where it will be glued, such as for example, the food packaging industry.

The oligoester can be applied during multiple points in the manufacturing of the paper or corrugated boxboard, provides a uniform coverage across the paper or board. As an alternative, the oligoester may be applied to specific areas of the paper or board which correspond to the areas being glued.

These and other advantages and features of the invention will become apparent upon review of the following specification.

DETAILED DESCRIPTION OF THE PREFERRED EMBODIMENTS

This invention relates to a method of treatment that imparts increased gluability properties to paper or board treated therewith.

The increased abilities afforded the treated paper or board are suited for all applications wherein effective gluability of coated paper or boards is required. The present invention finds particular application in the food packaging industry, wherein the packaging requires consistent coated surfaces with water and grease barrier properties.

Additionally, a treated paper or board, in accordance with the present invention, may be used to form, or may be combined with other components in the construction of packaging, wherein the ability to resist grease and water at ambient temperatures is a useful property.

The paper or board material for use in conjunction with the present invention can be synthetic, cellulosic or a composite thereof. Both white and colored (printed, dyed, etc.) paper or board can be effectively treated with the composition and method of the invention.

The treatment composition for treating paper or board, according to the present invention comprises at least one oligoester obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$—$C_{24}$-alcohols, $C_6$—$C_{18}$-alkylphenols or $C_8$—$C_{24}$-alkylamines and e) from 0.4 to 10 mol % of one or more polyols having from 3 to 6 hydroxyl groups.

Preferably, the at least one oligoester is obtained by polycondensation of a) from 45 to 50 mol %, of one or more dicarboxylic acids or esters thereof, b) from 20 to 35 mol %, of ethylene glycol and/or propylene glycol, c) from 10 to 15 mol %, of polyethylene glycol, d) from 1 to 7.5 mol %, of a water-soluble addition product of from 5 to 80 mol of an alkylene oxide with 1 mol of $C_1$—$C_{24}$-alcohols, $C_6$—$C_{18}$-alkylphenols or $C_8$—$C_{24}$-alkylamines and e) from 0.5 to 8 mol %, of one or more polyols having from 3 to 6 hydroxyl groups.

The at least one oligoester is present in the range of from 0.0005 lbs./MSF to 3 lbs./MSF, preferably from 0.005 lbs./MSF to 0.50 lbs./MSF and most preferably from 0.01 lbs./MSF to 0.10 lbs./MSF, wherein MSF denotes 1000 square feet.

The oligoester is available commercially from Clariant Corporation under the trademark CARTASPERS® PSM Liquid.

It was found that a paper or board with a high degree of recycled newsprint, required putting on pounds of dry starch per ton of board on the surface of the back side of the board. This can not be reduced because any less and the sheet had issues with linting. The combined starch and recycled newsprint were sealing off the board, not allowing any glue adhesion or penetration. There needed to be some glue penetration into the sheet in order to get it to stick.

The oligoester has good affinity for hot melt glue as one of its application is to pacify the "stickies" that come from recycled stock and not have the hot melt glue stick to the wire and rolls in a paper machine. Stickies are pieces of glue or other adhesive materials found in recycled stock, wherein hot melt glue can make up a large portion of the stickies in recycled stock.

An initial trial began by adding 1 pound of wet oligoester per 1000 pounds of wet starch. This dosage was proved effective. During subsequent runs, the glue adhesion decreased. The dosage of oligoester per 1000 pounds of wet starch was turned up to 2 and 3 pounds per 1000 pounds of wet starch. Subsequently, the process has been running around 3 pounds oligoester per 1000 pounds of wet starch without a derogatory effect to the grease and water resistance properties of the coated sheet. This was deemed a successful trial. The mechanism of the oligoester allowed it to grip onto the hot melt glue and allowed the end use boxes to pass the fiber tear testing.

The oligoester can raise the surface energy of the substrate. The raising of the surface energy can also improve ink adhesion, as described in Examples below, or adhesion of hydrophobic films.

The oligoester can be applied on the surface of a substrate as a film by application using a size press, calendar box, spray application, or any other type of coating or surface application of the water based chemical on the surface of a substrate for the purposes of improving glue adhesion.

The oligoester can be applied by inkjet, flexographic, and gravure type of printing where it can be applied across the entire surface of the substrate, or in preferential locations on the substrate for the purposes of improving glue adhesion.

There are many methods to measure glue adhesion. The glue can be cold set or hot melt glue. For a paper substrate, typically there is delamination, or tearing of the fibers from the paper substrate when trying to separate two glued pieces of paper, and this indicates good glue adhesion. In cases of poor adhesion, there is little if any delamination, or tearing of the fibers from the paper substrate because the glue is not "grabbing" onto the substrate. Automated tensile equipment can be used to measure the force required to separate the glued substrates.

There are many applications for glueing substrates together. For paper, the more common applications are glueing of corrugated box, glueing of boxboard for packaging, etc. The paper can be coated or uncoated and bleached or unbleached. It can be single ply, double ply, triple ply, or any number of plys (multi-ply boxboard).

The following non-limiting examples disclose the inventive oligoesters and describe in detail methods of their application to various substrates. They also demonstrate the good performance of the copolymers on the various substrates.

EXAMPLES

The following commercially available chemicals were used in the Coating Formulations:

Cartaseal TXU Liquid is available commercially from Clariant Corporation. Cartaseal TXU Liquid is a product for imparting water and grease resistant properties to paper or board. In addition, the coated sheet exhibits heat resistance up to 200° C. Typical applications for Cartaseal TXU Liquid may include paper plates and food packaging grades requiring water and grease resistance. Cartaseal TXU Liquid is an aqueous proprietary formulation, and can be applied by a large variety of aqueous coating and printing techniques, provided non-contact drying is available. A minimum drying temperature of 55° C. is recommended to ensure good film formation.

Cartaseal HFU Liquid is available commercially from Clariant Corporation. Cartaseal HFU Liquid is a product designed for making packaging resistant to water where direct food contact is required. Typical applications are corrugated board where moderate water resistance is required. Cartaseal HFU Liquid is an aqueous formulation containing a mixture of special synthetic emulsions. It can be applied by a variety of aqueous coating techniques, including size press, film press, rod, air-knife, roll, gravure and blade coating, and should be applied as a single coated layer.

Coating Formulation A was composed of 100 g of Cartaseal TXU Liquid at 40.0 solids.

Coating Formulation B was composed of 100 g of Cartaseal TXU Liquid at 40.0% solids and 5.0 g of Cartaseal HFU Liquid at 34% solids. The total solids for Coating Formulation B was 39.7%.

Coating Formulation C was composed of 100 g of Cartaseal TXU Liquid at 40.0% solids and 1.0 g of the oligoester (CARTASPERS® PSM Liquid) at 20% solids. The total solids for Coating Formulation C was 39.8%.

Coating Formulation D was composed of 100 g of Cartaseal TXU Liquid at 40.0% solids and 3.0 g of the oligoester (CARTASPERS® PSM Liquid) at 20% solids. The total solids for Coating Formulation D was 39.4%.

Coating Formulation E was composed of 100 g of Cartaseal TXU Liquid at 40.0% solids and 5.0 g of the oligoester (CARTASPERS® PSM Liquid) at 20% solids. The total solids for Coating Formulation E was 39.0%.

Each coating formulation was applied to uncoated liner board of unbleached kraft used for corrugated boxes, with a 7 RDS rod, wherein the RDS rod is a brand of Meyer Rod (manufactured by RD Specialties, 560 Salt Road, Webster, N.Y., 14580), the number of the rod is an indicator of the amount of coating that will be deposited. In each case 0.83 lbs./MSF, wherein MSF denotes 1000 square feet, was deposited on the uncoated liner board. The coated sheets were dried in an oven at 105° C. for 3 minutes and flattened in a flat bed dryer for 2 minutes.

The coated sheets which were labeled according to the Coating Formulation A through E were evaluated for adhesive and cohesive strength by four methods:

Method 1

A 1"×6" strip of each coated sheet (A-E) was folded and a line of hot melt glue was placed in the fold. A roller (11-kg) was run back and forth over the sample thrice. A protective white sheet (17"×24") was used as a barrier such that the hot melt glue did not adhere to the roller. The results of this method were that all of the Coated Sheets (A-E) had delamination, therefore the adhesive strength was stronger than the coated sheet strength.

Method 2

Strips of hot melt glue were applied to flat 6"×6" squares of each coated sheet (A-E), (no pressure applied). After drying, the strips of glue were removed. The results of this method were that all of the Coated Sheets (A-E) had delamination, therefore the adhesive strength was stronger than the coated sheet strength.

Method 3

A 3"×6" strip of each coated sheet (A-E) was folded and a line of liquid glue was applied across the fold. A roller (11-kg) was run back and forth over the sample thrice. A protective white sheet (17"×24") was used as a protective barrier such that the liquid glue did not adhere to the roller. The results of this method were that Coated Sheets A and B had adhesive failure, Coated Sheets C, D and E had fiber pull. The oligoester appears to improve the adhesive strength.

Method 4

Release tape was applied to the edges of a 6"×6" square of each coated sheet (A-E). The square was folded and a line of liquid glue was placed in the fold. A roller (11 kg) was run back and forth over the sample once. A protective white sheet (17"×24") was used as a protective barrier such that the liquid glue did not adhere to the roller. Samples were placed between blotter paper and placed in a hand sheet lab press at a pressure 700 psi for a period of 20 minutes. The samples were then placed between thin blotters and run through the lab dryer can. The results of this method were that Sheets A and B had adhesive failure. Sheets C, D, and E had fiber pull. The oligoester improves the adhesive strength.

Method 4 was the most reliable test for measuring the differences in performance.

The surface energy of Coated Sheet A, C and D was measured with Accu Dyne Test marker pens from Diversified Enterprises, 101 Mulberry Street, Suite 2N, Claremont, N.H. 03743. Sheet A (without oligoester) had a surface energy of 32-34 dynes/cm$^2$, Sheet C and D (with oligoester) had a surface energy of 50-52 dynes/cm$^2$ and 54 dynes/cm$^2$, respectively. The oligoester clearly increases the surface energy of the coated sheets.

The ink recipitivity was also examined with a waterborne flexographic ink. Coated Sheet B (without oligoester) had poor ink recipitivity and Coated Sheet E (with oligoester) had excellent ink receptivity.

The water absorptiveness of the Coated Sheet A and Coated Sheet C was determined by TAPPI Test Method T 441 om-98. The test result for Coated Sheet A was 18.2 g/m$^2$ and for Coated Sheet C was 20.5 g/m$^2$, therefore the absorptiveness of the sheets was not significantly increased by the oligoester.

The embodiments of the invention in which an exclusive property or privilege is claimed are defined as follows:

1. A method for increasing the gluability of paper or board comprising the step of contacting the paper or board with at least one oligoester consisting of a polycondensation product of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$-$C_{24}$-alcohols, $C_6$-$C_{18}$-alkylphenols or $C_8$-$C_{24}$-alkylamines and e) from 0.4 to 10 mol % of one or more polyols having from 3 to 6 hydroxyl groups.

2. A method according to claim 1, wherein the at least one oligoester consists of a polycondensation product of a) from 45 to 50 mol %, of one or more dicarboxylic acids or esters thereof, b) from 20 to 35 mol %, of ethylene glycol and/or propylene glycol, c) from 10 to 15 mol %, of polyethylene glycol, d) from 1 to 7.5 mol %, of a water-soluble addition product of from 5 to 80 mol of an alkylene oxide with 1 mol of $C_1$-$C_{24}$-alcohols, $C_6$-$C_{18}$-alkylphenols or $C_8$-$C_{24}$-alkylamines and e) from 0.5 to 8 mol %, of one or more polyols having from 3 to 6 hydroxyl groups.

3. A method according to claim 1, wherein the contacting step is accomplished during the manufacture of the paper or board.

4. A method according to claim 1, wherein the contacting step is accomplished after the paper or board has been formed.

5. A method for increasing the gluability of paper or board comprising the step of contacting the paper or board with at least one oligoester obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$-$C_{24}$-alcohols, $C_6$-$C_{18}$-alkylphenols or $C_8$-$C_{24}$-alkylamines and e) from 0.4 to 10 mol % of one or more polyols having from 3 to 6 hydroxyl groups wherein the contacting step is accomplished by applying the oligoester onto the paper or board in limited areas corresponding to the areas of glue application and wherein the contacting step is accomplished after the paper or board has been formed.

6. A method for increasing the gluability of paper or board comprising the step of contacting the paper or board with at least one oligoester obtained by polycondensation of a) from 40 to 52 mol % of one or more dicarboxylic acids or esters thereof, b) from 10 to 40 mol % of ethylene glycol and/or propylene glycol, c) from 3 to 20 mol % of polyethylene glycol, d) from 0.5 to 10 mol % of a water-soluble addition product of from 5 to 80 mol of an alkylene oxide with 1 mol of $C_1$-$C_{24}$-alcohols, $C_6$-$C_{18}$-alkylphenols or $C_8$-$C_{24}$-alkylamines and e) from 0.4 to 10 mol % of one or more polyols having from 3 to 6 hydroxyl groups, wherein the contacting step is accomplished by printing the oligoester onto the paper or board in limited areas corresponding to the areas of glue application and wherein the contacting step is accomplished after the paper or board has been formed.

7. A paper or board made by the method according to claim 5.

8. An article made from the paper or board according to claim 7.

9. A paper or board made by the method according to claim 6.

10. An article made from the paper or board according to claim 9.

* * * * *